US006123513A

United States Patent [19]

Hiramatsu et al.

[11] Patent Number: 6,123,513

[45] Date of Patent: Sep. 26, 2000

[54] COMPRESSOR WITH IMPROVED PISTON FOR LUBRICATING THE COUPLING PORTION BETWEEN THE PISTON AND THE DRIVING BODY

[75] Inventors: Osamu Hiramatsu; Shigeki Kanzaki; Kazushige Murao; Takahiro Hoshida, all of Kariya, Japan

[73] Assignee: Kabushiki Kaisha Toyoda Jidoshokki Seisakusho, Kariya, Japan

[21] Appl. No.: 08/909,707

[22] Filed: Aug. 8, 1997

[30] Foreign Application Priority Data

Aug. 9, 1996 [JP] Japan ..... 8-211621

[51] Int. Cl.[7] ..... F04B 1/28; F04B 21/04

[52] U.S. Cl. ..... 417/222.2; 92/12.2; 92/71

[58] Field of Search ..... 417/222.2; 92/154, 92/12.2, 171

[56] References Cited

U.S. PATENT DOCUMENTS

| | | | |
|---|---|---|---|
| 5,174,728 | 12/1992 | Kimura et al. | 417/222.2 |
| 5,293,810 | 3/1994 | Kimura et al. . | |
| 5,382,139 | 1/1995 | Kawaguchi et al. | 417/269 |
| 5,498,140 | 3/1996 | Kawaguchi et al. | 417/199 |
| 5,816,134 | 10/1998 | Takenaka et al. | 92/154 |

FOREIGN PATENT DOCUMENTS

| | | |
|---|---|---|
| 4230353 | 4/1993 | Germany . |
| 861237 | 3/1996 | Japan . |

*Primary Examiner*—Timothy S. Thorpe
*Assistant Examiner*—Cheryl J. Tyler
*Attorney, Agent, or Firm*—Morgan & Finnegan, L.L.P.

[57] ABSTRACT

A piston for use in a compressor that compresses gas containing lubricating oil is disclosed. The compressor has a crank chamber and cylinder bores for accommodating the pistons. A swash plate is located in the crank chamber and is supported on a drive shaft for integrally rotating with the drive shaft. The swash plate is operably connected to the pistons by shoes to convert the rotation of the drive shaft to reciprocation of each piston. Each piston has a head for compressing the gas supplied to the cylinder bore and a skirt projecting from the head toward the crank chamber. The skirt has a slot for receiving the swash plate by means of the shoes. A rib is formed on an inner wall of the slot and extends parallel to the axis of the piston. When the swash plate rotates, swirling gas in the crank chamber collides against the rib. When the gas collides against the rib, the oil contained in the gas separates from the gas and is guided to the shoes.

16 Claims, 5 Drawing Sheets

COMPRESSOR WITH IMPROVED PISTON FOR LUBRICATING THE COUPLING PORTION BETWEEN THE PISTON AND THE DRIVING BODY

BACKGROUND OF THE INVENTION

1. Field of the Invention

The present invention relates to piston type compressors that convert rotation of a drive shaft to linear reciprocation of a piston with a swash plate, and more particularly, to pistons used in such compressors.

2. Description of the Related Art

Compressors are employed in air-conditioning systems for vehicles. Piston type compressors are used in such systems. As shown in FIG. 7, a typical piston type compressor is provided with a driving body, such as a swash plate 100. The swash plate 100 is fitted on a drive shaft 104 in a crank chamber 103 defined between a cylinder block 101 and a front housing 102. The swash plate 100 is inclinable with respect to the drive shaft 104 while rotating integrally with the drive shaft 104. A piston 105 is accommodated in a cylinder bore 101*a*, which is defined in the cylinder block 101. The piston 105 has a skirt 105*a* that projects toward the crank chamber 103. A slot 105*b* is provided in the skirt 105*a*. A pair of shoes 106 are slidably fitted in the opposing walls of the slot 105*b*. The peripheral portion of the swash plate 100 is slidably held between the shoes 106.

The rotation of the drive shaft 104 is converted to linear reciprocation of the piston 105 in the cylinder bore 110*a* by means of the swash plate 100 and the shoes 106. The reciprocation of the piston 105 draws refrigerant gas into the cylinder bore 101*a* from a suction chamber (not shown), compresses the gas in the cylinder bore 101*a,* and discharges the gas into a discharge chamber (not shown).

The shoes 106 coupling the piston 105 to the swash plate 100 slide against the swash plate 100 and the walls of the slot 105*b*. Furthermore, the force of the swash plate 100, which reciprocates the piston 105, and the compressor reaction, which is produced by the compressing action of the piston 105, is applied to a coupling portion of the piston 105, which couples the piston with the swash plate 100. Thus, the coupling portion must be lubricated sufficiently.

Some types of compressors draw refrigerant gas into the suction chamber from an external refrigerant circuit by way of the crank chamber. In such compressors, the refrigerant gas from the external refrigerant circuit passes through the crank chamber. Thus, the lubricating oil suspended in the refrigerant gas, which passes through the crank chamber, lubricates various parts of the crank chamber.

However, the compressor of FIG. 7 is a variable displacement compressor in which the displacement of the compressor is varied in accordance with the inclination of the swash plate 22. In this compressor, the inclination of the swash plate 22 changes in accordance with the difference between the pressure of the crank chamber 103 and the pressure of the cylinder bore, 101*a*. The pressure difference between the crank chamber 103 and the cylinder bore 101*a* is altered by adjusting the pressure of the crank chamber 103 with a control valve (not shown) or the like. Accordingly, in such a variable displacement compressor, the refrigerant gas from the external refrigerant circuit is directly drawn into the suction chamber without passing through the crank chamber 103 since the pressure of the crank chamber 103 must be adjusted to control the inclination of the swash plate 100.

Therefore, it is difficult to provide the crank chamber 103 of the compressor shown in FIG. 7 with a sufficient amount of lubricating oil. As a result, tho lubrication of the coupling portion of the piston 105 may become insufficient.

The slot 105*b* provided in the skirt 105*a* of the piston 105 results in the skirt 105*a* being thin. In addition, concentrated stress tends to act on the pair of inner corners 105*c* in the slot 105, and especially, on the inner corner 105*c* that is farther from the head of the piston 105. For example, when the piston 105 moves from the top dead center position to the bottom dead center position, the swash plate 100 urges the skirt 105*a* toward the left, as viewed in FIG. 7, by means of the shoes 106. During this action, a force acting to open the slot 105*b* is applied to the inner corners 105*c* in a concentrated manner. This may lead to deformation or damage to the skirt 105*a* and degrade the performance of the compressor.

SUMMARY OF THE INVENTION

Accordingly, it is an objective of the present invention to provide a compressor piston that more effectively lubricated the coupling portion between the piston and the driving body and has a skirt with improved strength.

To achieve the above objective, the present invention discloses a piston for use in a compressor that compresses gas containing lubricating oil. The compressor includes a housing having a crank chamber and a cylinder bore for accommodating the piston, and a driving body located in the crank chamber. The driving body is operably connected to the piston by a connecting joint. The driving body reciprocates the piston by means of the connecting joint when the driving body rotates. The piston comprises a head for compressing the gas supplied to the cylinder bore and a skirt projecting from the head toward the crank chamber. The skirt has a slot for receiving the driving body by means of the connecting joint. A lubricant receiving wall is formed on an inner wall of the slot. The lubricant receiving wall has a collision surface against which swirling gas in the crank chamber collides when the driving body rotates.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A compressor employing pistons according to a first embodiment of the present invention will now be described with reference to FIGS. 1 to 4.

Figure 1:
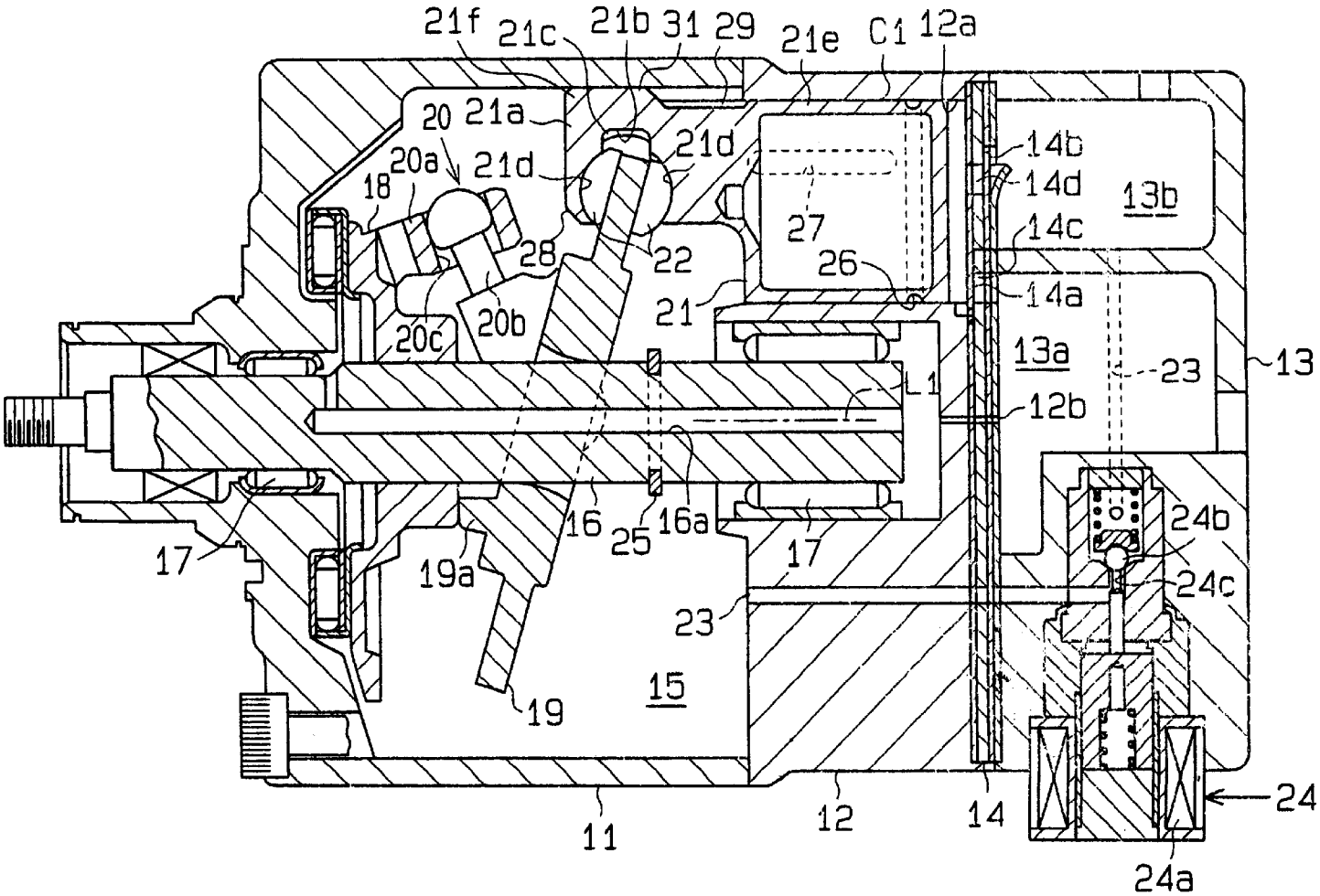
FIG. 1 is a cross-sectional view showing a compressor employing pistons according to a first embodiment of the present invention.

As shown in FIG. 1, a front housing 11 is secured to the front end of a cylinder block 12. A rear housing 13 is secured to the rear end of the cylinder block 12 with a valve plate 14 arranged in between. The front housing 11, the cylinder block 12, and the rear housing 13 constitute the compressor housing.

A suction chamber 13*a* and a discharge chamber 13*b* are defined in the rear housing 13, The valve plate 14 is provided with suction valves 14*a*, discharge valves 14*b*, suction ports 14*c*, and discharge ports 14*d*. A crank chamber 15 is defined between the front housing 11 and the cylinder block 12. A drive shaft 16 extends through the crank chamber 15 and is rotatably supported by a pair of bearings 17 in the front housing 11 and the cylinder block 12.

A lug plate 18 is fixed to the drive shaft 16. A swash plate 19, which serves as a driving body, is supported in the crank chamber 15 by the drive shaft 16 so that it is slidable along and inclinable with respect to the axis L1 of the shaft 16. The swash plate 19 is connected to the lug plate 18 by a hinge mechanism 20. The hinge mechanism 20 is constituted by a support arm 20*a*, which projects from the lug plate 18, and a pair of guide pins 20*b*, which are projected from the swash plate 19. The guide pins 20*b* slidably fit into a pair of guide bores 20*c*, which extend through the support arms 20*a*. The hinge mechanism 20 integrally rotates the swash plate 19 with the drive shaft 16. The hinge mechanism 20 also guides the inclination and movement of the swash plate 19 in the direction of the axis L1.

A plurality of cylinder bores 12*a* extend through the cylinder block 12 about the drive shaft 16. A single-headed piston 21 is reciprocally retained in each cylinder bore 12*a*. The piston 21 includes a hollow head 21*e* and a skirt 21*a*, which projects from the rear end of the head 21*e* toward the crank chamber 15. A slot 21*b* is provided in the skirt 21*a*. The slot 21*b* has a pair of opposing walls. Each wall defines a round, concave seat 21*d* to receive a shoe 22. The round portion of each shoe 22 is slidably received in a corresponding seat 21*d*.

The peripheral portion of the swash plate 19 is slidably held in the slot 21*b* of each piston 21 between the flat portions of the associated pair of shoes 22. Each shoe 22 serves as a connecting member, which connects the piston 21 to the swash plate 19. The rotation of the drive shaft 16 is converted to linear reciprocation of each piston 21 in the associated cylinder bore 12*a*. During the suction stroke, in which the piston 21 moves from the top dead center position to the bottom dead center position, the refrigerant gas in the suction chamber 13*a* is forced through the associated suction port 14*c* and suction valve 14*a* and drawn into the cylinder bore 12*a*. During the compression stroke, in which the piston 21 moves from the bottom dead center position to the top dead center position, the refrigerant gas in the cylinder bore 12*a* is compressed and forced out of the bore 12*a* through the associated discharge part 14*d* and discharge valve 14*b* and discharged into the discharge chamber 13*b*.

A pressurizing passage 23 extends through the cylinder block 12, the valve plate 14, and the rear housing 13 to connect the discharge chamber 13*b* to the crank chamber 15. An electromagnetic valve, or displacement control valve 24, is provided in the rear housing 13 and arranged in the pressurizing passage 23. The control valve 24 includes a solenoid 24*a*, a body 24*b*, and an aperture 24*c*. When the solenoid 24*a* is excited, the body 24*b* closes the aperture 24*c*. When the solenoid is de-excited, the body 24*b* opens the aperture 24*c*.

A pressure releasing passage 16*a* extends through the drive shaft 16. A pressure releasing bore 12*b* extends through the cylinder block 12 and the valve plate 14. The releasing passage 16*a* and the releasing bore 12*b* connect the crank chamber 15 to the suction chamber 13*a*.

When the solenoid 24*a* is excited and the pressurizing passage 23 is closed, the high-pressure refrigerant gas in the discharge chamber 13*b* is not sent to the crank chamber 15. In this state, the refrigerant gas in the crank chamber 15 flows into the suction chamber 13*a* through the releasing passage 16*a* and the releasing bore 12*b*. This causes the pressure of the crank chamber 15 to approach the low pressure of the suction chamber 13*a*. As a result, the swash plate 19 is moved to a maximum inclination position, as shown in FIG. 1, and the displacement of the compressor becomes maximum. The swash plate 19 is restricted from inclining beyond the maximum inclination position by the abutment of a stopper 19*a*, which is provided on the front side of the swash plate 19, against the lug plate 18.

When the solenoid 24*a* is de-excited and the pressurizing passage 23 is opened, the high-pressure refrigerant gas in the discharge chamber 13*b* is sent to the crank chamber 15. This increases the pressure of the crank chamber 15. As a result, the swash plate 19 is moved to a minimum inclination position and the displacement of the compressor becomes minimum. The swash plate 19 is restricted from inclining further beyond the minimum inclination position by the abutment of the swash plate 19 against a ring 25, which is fitted to the drive shaft 16.

As described above, the pressure of the crank chamber 15 is adjusted by exciting the solenoid 24*a* of the control valve 24 to close the pressurizing passage 23 or by de-exciting the solenoid 24*a* to open the pressurizing passage 23. When the pressure of the crank chamber is changes, the difference between the pressure of the crank chamber 15 acting on the rear surface of the piston 21 (to the left as viewed in FIG. 1) and the pressure of the cylinder bore 12*a* acting on the front surface of the piston 21 (to the right as viewed in FIG. 1) is altered. The inclination of the swash plate 19 is altered in accordance with the pressure difference. This changes the stroke of the pistons 21 and varies the displacement of the compressor.

Figure 2:
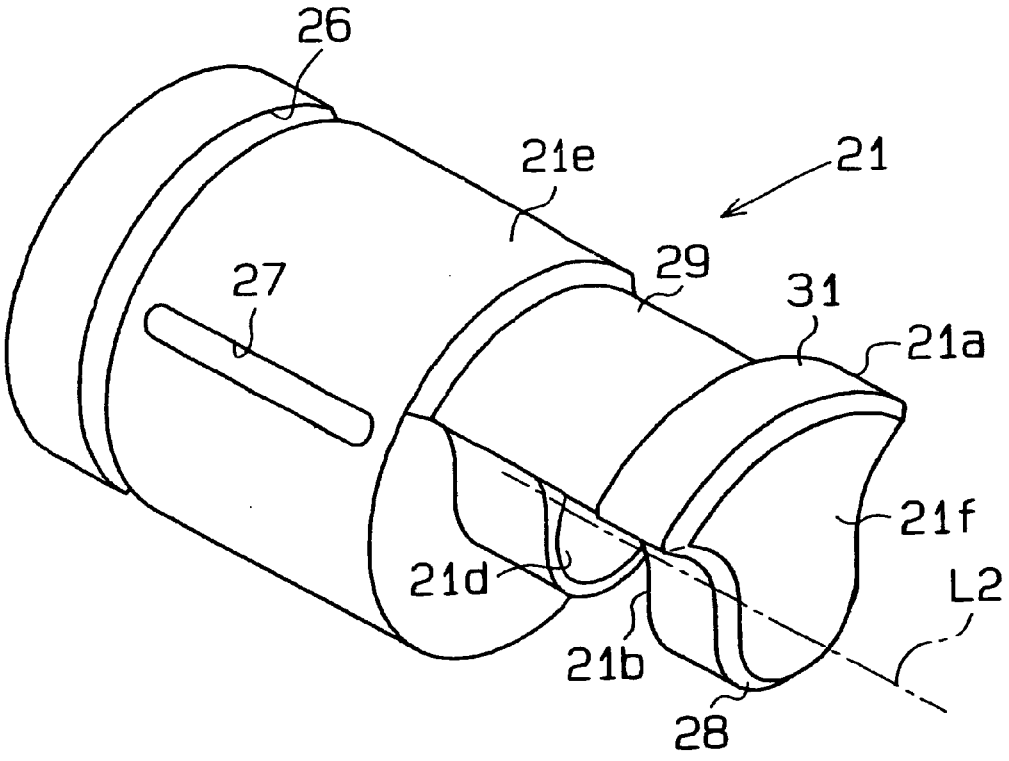
FIG. 2 is an enlarged perspective view showing the piston of FIG. 1.

As shown in FIGS. 1 and 2, each piston 21 has an annular groove 26, which extends in the circumferential direction along the cylindrical outer surface of the piston 21 near the end of the head 21*e*. The annular groove 26 is provided at a position where the groove 26 is not exposed to the inside of the crank chamber 15 when the piston 21 is located at the bottom dead center position. Each piston 21 also has a linear groove 27, which extends along the outer surface of the head 21*e* parallel to the axis L2 of the piston 21. One end of the linear groove 27 is located in the vicinity of the annular groove 26.

When each piston 21 reciprocates in the associated cylinder bore 12*a*, some or the lubricating oil suspended in the refrigerant gas adheres to the wall of the cylinder bore 12*a*. As the piston 21 reciprocates, the lubricating oil on the wall of the cylinder bore 12*a* is wiped off by the edge of the annular groove 26 in the piston 21 and collected in the groove 26. The lubricating oil collected in the groove 26 is then moved into the linear groove 27 through a narrow clearance C1 that is provided between the outer surface of the piston 21 and the wall of the cylinder bore 12*a*.

As shown in FIGS. 1 to 4, a substantially T-shaped rotation restrictor 21*f* is provided on each piston 21 at the distal end of the skirt 21*a*. A beveled surface 28 extends along the periphery of the end face of the restrictor 21*f*.

Each piston 21 is also provided with a recess 29 that is arranged adjacent to the restrictor 21*f*. The recess 29 faces the inner surface of the front housing 11 and extends along the skirt 21*a*. A cylindrical surface 31 facing the inner surface of the front housing 11 is provided on the restrictor 21*f*. The radius of curvature of the cylindrical surface 31 is substantially the same as that of the inner surface of the front housing 11. During reciprocation of the piston 21, the cylindrical surface 31 of the restrictor 21*f* slides against the inner surface of the front housing 11. This prevents the piston 21 from rotating about its axis L2.

Figure 3:
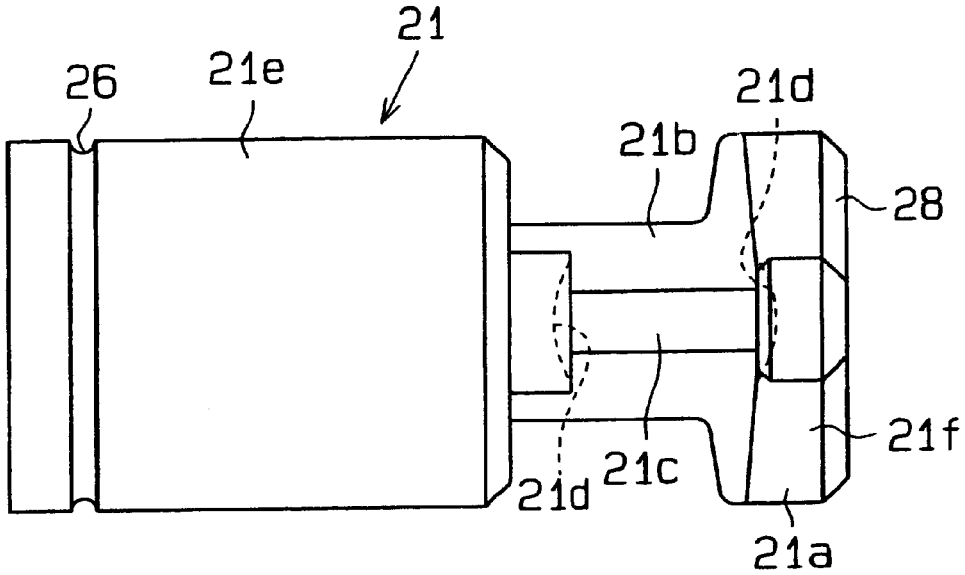
FIG. 3 is an enlarged bottom view showing the piston of FIG. 1.
Figure 4:
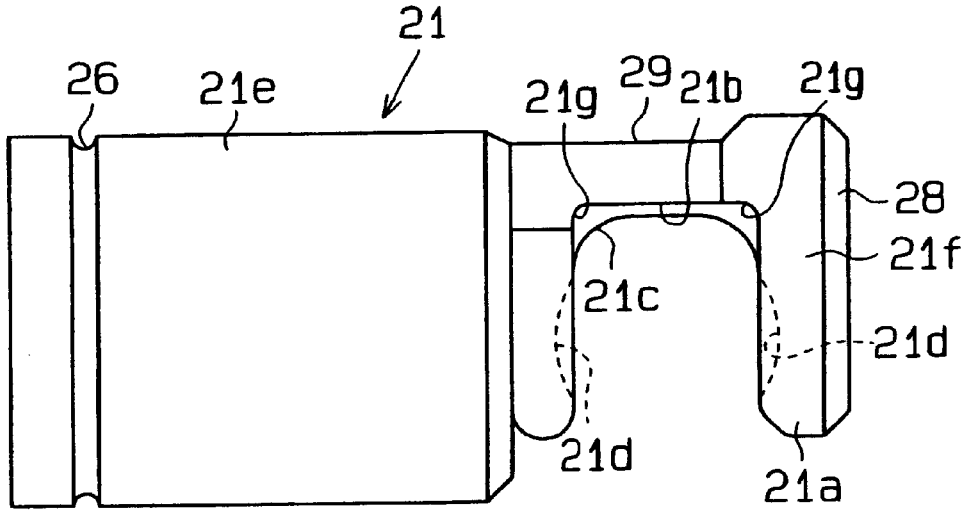
FIG. 4 is an enlarged side view showing the piston of FIG. 1.

As shown in FIGS. 1, 3, and 4, each piston 21 has a rib 21*c* extending parallel to the axis L2 of the piston 21 and formed integrally with the inner wall of the slot 21*b*. The rib 21*c* is connected to a pair of inner corners 21*g* in the slot 21*b*. Furthermore, each end of the rib 21*c* is substantially continuous with the associated seat 21*d*. That is, the ends of the rib 21*c* meet with the edges of the seats 21*d*, as seen in FIG. 4.

The operation of the compressor having the above structure will now be described.

The rotation of the drive shaft 16 is converted to the reciprocation of the pistons 21 by means of the swash plate 19 and the shoes 22. The inclination of the swash plate 19 determines the stroke of the pistons 21. This, in turn, determines the displacement of the compressor. The refrigerant gas in the crank chamber 15 includes mist-like lubricating oil. During operation of the compressor, the rotation of the swash plate 19 swirls the refrigerant gas in the crank chamber 15 about the drive shaft 16 in the rotating direction of the swash plate 19. When the swirling refrigerant gas passes through the space between the slot 21*b* of each piston 21 and the swash plate 19, the gas collides against the rib 21*c* provided on the inner wall of the slot 21*b*. Some of the lubricating oil separates from the refrigerant gas and adheres to the rib 21*c*. The lubricating oil adhered to the rib 21*c* is guided to the shoes 22 and sufficiently lubricates the shoes 22.

The rib 21*c* has a planar surface that is perpendicular to the rotating direction or the swash plate 19. Accordingly, the refrigerant gas that swirls during the rotation of the swash plate 19 collides substantially at a right angle against the rib 21*c*. Thus, the collision of the refrigerant gas against the rib 21*c* efficiently separates the lubricating oil from the refrigerant gas.

The ends of the rib 21*c* are substantially continuous with the associated seats 21*d*, which receive the shoes 22. Therefore, the lubricating oil applied to the rib 21*c* smoothly moves into the space between the seats 21*d* and the shoes 22 and sufficiently lubricates the contacting portions of the associated seats 21*d* and shoes 22.

Although the slot 21*b* causes the skirt 21*a* or each piston 21 to be thin, the rib 21*c* reinforces the skirt 21*a*. In addition, the rib 21*c* is connected to the pair of inner corners 21*g* in the slot 21*g*. Thus, rib 21*c* reinforces the inner corners 21*g* at which stress concentrates during operation of the compressor. This effectively prevents deformation and damage to the skirt 21*a*.

When each piston 21 moves from the top dead center position toward the bottom dead center positions the lubricating oil applied to the end face of the skirt 21*a* and the inner surface of the front housing 11 and the lubricating oil collected at the bottom of the crank chamber 15 are guided along the beveled surface 28 of the skirt 21*a* toward the coupling portion connecting the piston 21 and the swash plate 19, or the shoes 22. This further efficiently lubricates the shoes 22.

The recess 29 provided in the skirt 21*a* of each piston 21 defines a lubricating oil passage between the skirt 21*a* and the inner surface of the front housing 11. The lubricating oil that enters the recess 29 by way of the beveled surface 28 smoothly moves toward the shoes 22.

Since only one rib 21*c* is provided on the inner wall of the slot 21*b*, the increase in the weight of the piston 21 is minimized.

Figure 5:
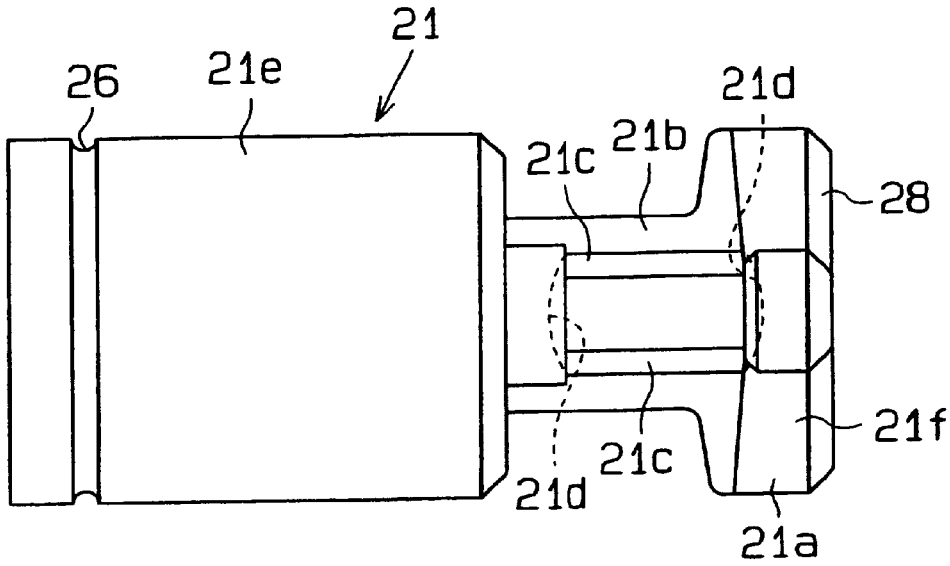
FIG. 5 is a bottom view showing a piston according to a second embodiment of the present invention.

A second embodiment according to the present invention will now be described with reference to FIG. 5. In this embodiment, two ribs 21*c* extend parallel to the axis of the piston 21. The ribs 21*c* are parallel to each other and are spaced from each other by a predetermined distance. This structure also achieves the advantageous effects of the first embodiment. Furthermore, the strength of the skirt 21*a* is further enhanced in this embodiment. In addition, this structure is effective for sufficient lubrication of the shoes 22 since lubricating oil tends to collect between the ribs 21*c*.

Figure 6:
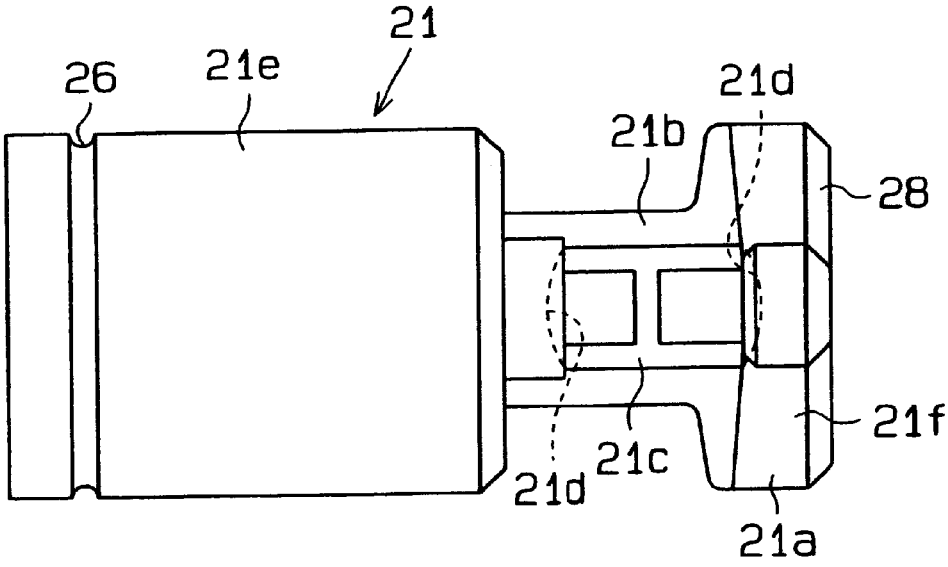
FIG. 6 is a bottom view showing a piston according to a third embodiment of the present invention.
Figure 7:
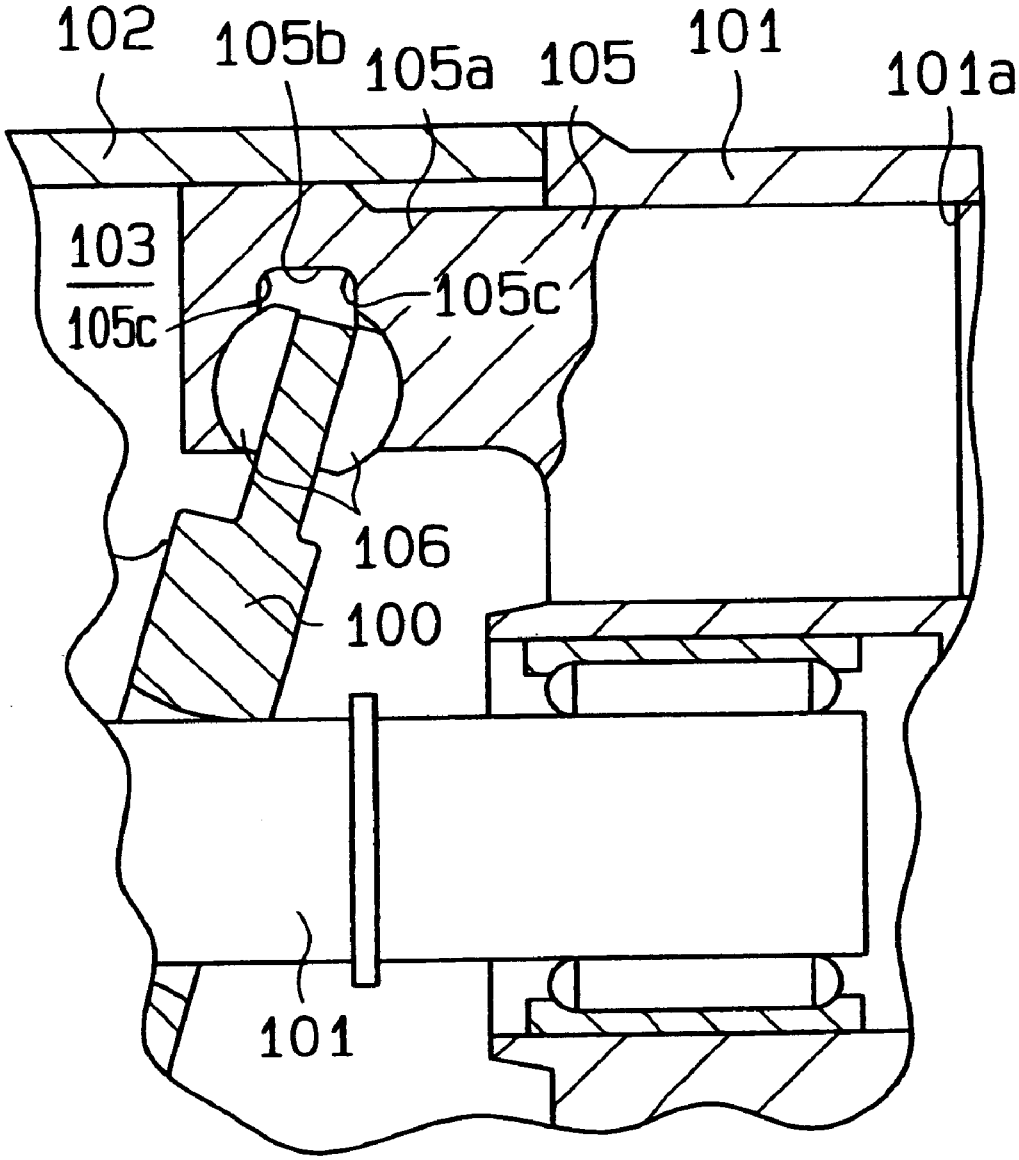
Fig.7 (Prior Art)
FIG. 7 is a cross-sectional view showing a portion of a prior art compressor.

A third embodiment according to the present invention will now be described with reference to FIG. 6. In this embodiment, the rib 21*c* is H-shaped when viewed from the bottom side. This structure also achieves the advantageous effects of the second embodiment. Furthermore, the strength of the skirt 21*a* is further enhanced in this embodiment.

Three or more ribs 21*c* may also be provided in the slot 21*b* of the skirt 21*a*. This structure also achieves the advantageous effects of the above embodiments.

Although several embodiments or the present invention have been described so far, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A piston for use in a compressor that compresses gas containing lubricating oil, wherein the compressor includes a housing having a crank chamber and a cylinder bore for accommodating the piston, and a driving body located in the crank chamber, wherein the driving body is operably connected to the piston by a connecting joint, and wherein the driving body reciprocates the piston by means of the connecting joint when the driving body rotates, the piston comprising:

a head for compressing the gas supplied to the cylinder bore;

a skirt projecting from the head toward the crank chamber, wherein the skirt has a slot for receiving the driving body by means of the connecting joint; and a lubricant receiving wall formed on an inner wall of the slot, wherein the lubricant receiving wall has a collision surface against which swirling gas in the crank chamber collides when the driving body rotates, wherein the oil contained in the gas separates from the gas and adheres to the lubricant receiving wall when the gas collides against the collision surface, wherein the lubricant receiving wall has a guiding portion for guiding the oil adhered to the lubricant receiving wall to the connecting joint.

2. The piston according to claim 1, wherein the collision surface faces a direction that is generally tangential to the driving body.

3. The piston according to claim 1, wherein the collision surface is generally planar, and wherein the plane of the collision surface is parallel to the axis of the piston.

4. The piston according to claim 3, wherein the lubricant receiving wall includes a pair of ribs arranged parallel to each other, the ribs being spaced from each other by a predetermined distance.

5. The piston according to claim 1, wherein the slot has a pair of inner corners therein, and wherein the lubricant receiving wall is connected to at least the inner corner that is farther from the head to reinforce the skirt.

6. The piston according to claim 1, wherein the connecting joint includes a pair of shoes received in the slot to slidably hold the driving body, wherein the inner wall of the slot has a pair of receiving seats for receiving the shoes, and wherein the lubricant receiving wall has a pair of ends substantially continuous with the associated receiving seats, wherein the ends for the guiding portion.

7. The piston according to claim 1, wherein the housing has an inner surface for defining the crank chamber, wherein the skirt has a restrictor slidably contacting the inner surface of the housing to prevent the piston from rotating in the cylinder bore, and wherein the skirt has a recess located between the restrictor and the head to define a space for allowing passage of the oil between the skirt and the inner surface of the housing.

8. The piston according to claim 1, wherein the compressor includes:

a swash plate forming the driving body;

a drive shaft for tiltably supporting the swash plate and integrally rotating the swash plate therewith, wherein the inclination of the swash plate varies in accordance with the difference between the pressure in the crank chamber and the pressure in the cylinder bore, and wherein the piston moves by a stroke determined by the inclination of the swash plate to control the displacement of the compressor; and means for adjusting the difference between the pressure in the crank chamber and the pressure in the cylinder bore.

9. A piston for use in a compressor that compresses gas containing lubricating oil, wherein the compressor includes a housing having a crank chamber and a cylinder bore for accommodating the piston, wherein a driving body is located in the crank chamber and is supported on a drive shaft for integrally rotating with the drive shaft, and wherein the driving body is operably connected to the piston by a connecting joint to convert the rotation of the drive shaft to reciprocation of the piston, the piston comprising:

a head for compressing the gas supplied to the cylinder bore;

a skirt projecting from the head toward the crank chamber, wherein the skirt has a slot for receiving the driving body by means of the connecting joint; and at least one rib formed on an inner wall of the slot, the rib extending parallel to the axis of the piston, wherein the rib has a collision surface, which is substantially perpendicular to a direction that is tangential to the driving body so that swirling gas in the crank chamber collides directly against the collision surface when the driving body rotates, wherein the oil contained in the gas separates from the gas and adheres to the rib when the gas collides against the rib, wherein the rib has a guiding portion for guiding the oil adhered to the rib to the connecting joint.

10. The piston according to claim 9, wherein the at least one rib is a pair or parallel ribs, wherein the ribs forming the pair are spaced from each other by a predetermined distance.

11. The piston according to claim 9, wherein the slot has a pair of inner corners therein, and wherein the rib is connected to the inner corners to reinforce the skirt.

12. The piston according to claim 9, wherein the connecting joint includes a pair of shoes received in the slot to slidably hold the driving body, wherein the inner wall of the slot has a pair of receiving seats for receiving the shoes, and wherein the rib has a pair of ends substantially continuous with the associated receiving seats, wherein the ends form the guiding portion.

13. The piston according to claim 12, wherein the housing has an inner surface for defining the crank chamber, wherein the skirt has a restrictor slidably contacting the inner surface of the housing to prevent the piston from rotating in the cylinder bore, and wherein the skirt has a recess located between the restrictor and the head to define a space for allowing passage of the oil between the skirt and the inner surface of the housing.

14. The piston according to claim 12, wherein the compressor includes:

a swash plate forming the driving body and tiltably supported on the drive shaft, wherein the inclination of the swash plate varies in accordance with the difference between the pressure in the crank chamber and the pressure in the cylinder bore, and wherein the piston moves by a stroke determined by the inclination of the swash plate to control the displacement of the compressor; and means for adjusting the difference between the pressure in the crank chamber and the pressure in the cylinder bore.

15. A compressor for compressing gas containing lubricating oil, wherein the compressor includes a housing having a crank chamber and a cylinder bore, a driving body located in the crank chamber and supported on a drive shaft for integrally rotating with the drive shaft, and a piston accommodated in the cylinder bore and operably connected to the driving body by a connecting joint, wherein the driving body converts the rotation of the drive shaft to reciprocation of the piston, the compressor comprising:

a head on the piston for compressing the gas supplied to the cylinder bore;

a skirt projecting from the head toward the crank chamber, wherein the skirt has a slot for receiving the driving body by means of the connecting joint; and at least one rib formed on an inner wall of the slot, the rib extending parallel to the axis of the piston, wherein the rib has a collision surface, which is substantially perpendicular to a direction that is tangential to the driving body so that swirling gas in the crank chamber collides directly against the collision surface when the driving body rotates, wherein the oil contained in the gas separates from the gas and adheres to the rib when the gas collides against the rib, wherein the rib has a guiding, portion for guiding the oil adhered to the rib to the connecting joint.

16. A piston for use in a compressor that compresses gas containing lubricating oil, wherein the compressor includes a housing having a crank chamber and a cylinder bore for accommodating the piston, and a driving body located in the crank chamber, wherein the driving body is operably connected to the piston by a connecting joint, and wherein the driving body reciprocates the piston by means of the connecting joint when the driving body rotates, the piston comprising:

a head for compressing the gas supplied to the cylinder bore;

a skirt projecting from the head toward the crank chamber, wherein the skirt has a slot for receiving the driving body by means of the connecting joint, the slot being defined by a pair of opposing seats for receiving the connecting joint and a bottom wall located between the seats; and a lubricant receiving wall formed on the bottom wall, the lubricant receiving wall extending in a direction that is parallel to the axis of the piston, wherein the lubricant receiving wall has a collision surface against which swirling gas in the crank chamber collides when the driving body rotates, wherein the oil contained in the gas separates from the gas and adheres to the lubricant receiving wall when the gas collides against the collision surface, wherein the lubricant receiving wall has a guiding portion for guiding the oil adhered to the lubricant receiving wall to the seats.

* * * * *

UNITED STATES PATENT AND TRADEMARK OFFICE

CERTIFICATE OF CORRECTION

PATENT NO. : 6,123,513
DATED : September 26, 2000
INVENTOR(S) : Osamu Hiramatsu et al.

It is certified that error appears in the above-identified patent and that said Letters Patent is hereby corrected as shown below:

Column 1,
Line 31, please change: "bore 110a" to -- bore 101a --
Line 59, please change: "cyclinder bore, 101a" to -- cylinder bore 101a --;

Column 2,
Line 20, please change: "that more effectively lubricated" to -- that more effectively lubricates --;

Column 4,
Line 32, please change: "crank chamber is" to -- the crank chamber 15 --;

Column 5,
Line 58, please change: "dead center positions the" to -- dead center position, the --;

Column 7,
Line 61, please change: "pair or parallel" to -- pair of parallel --; and Column 8,
Line 49, please change: "guiding, portion" to -- guiding portion --.

Signed and Sealed this

Fifth Day of March, 2002

*Attest:*

*Attesting Officer*

JAMES E. ROGAN
*Director of the United States Patent and Trademark Office*